United States Patent [19]

Krause

[11] 4,249,599

[45] Feb. 10, 1981

[54] WELL SAFETY SYSTEM

[75] Inventor: William F. Krause, Houston, Tex.

[73] Assignee: Hydril Company, Los Angeles, Calif.

[21] Appl. No.: 89,184

[22] Filed: Oct. 29, 1979

[51] Int. Cl.[3] ..... E21B 34/10; E21B 34/16; E21B 43/12

[52] U.S. Cl. ..... 166/72; 166/319; 166/322; 166/323

[58] Field of Search ..... 166/319, 321–324, 166/332, 72

[56] References Cited

U.S. PATENT DOCUMENTS

| | | | |
|---|---|---|---|
| 2,894,715 | 7/1959 | Bostock | 166/324 X |
| 3,035,808 | 5/1962 | Knox | 166/323 X |
| 3,744,564 | 7/1973 | Mott | 166/322 |
| 3,763,932 | 10/1973 | Dinning | 166/322 X |
| 3,786,863 | 1/1974 | Tausch | 166/322 X |
| 3,799,258 | 3/1974 | Tausch | 166/323 X |
| 3,844,345 | 10/1974 | Evans et al. | 166/72 |
| 3,854,502 | 12/1974 | Mott | 166/324 X |
| 3,860,066 | 1/1975 | Pearce et al. | 166/72 |

*Primary Examiner*—Stephen J. Novosad

*Attorney, Agent, or Firm*—Pravel, Gambrell, Hewitt, Kirk, Kimball & Dodge

[57] ABSTRACT

A subsurface well safety apparatus for controlling control fluid used to operate subsurface safety valves mounted in well production tubing. The apparatus is operated by a shifting tool between a first position enabling a pair of tandem subsurface safety valves to operate together and a second position to isolate one of the subsurface safety valves from the control fluid. The apparatus is shifted between positions by a tool movable through the production tubing to the subsurface location.

5 Claims, 5 Drawing Figures

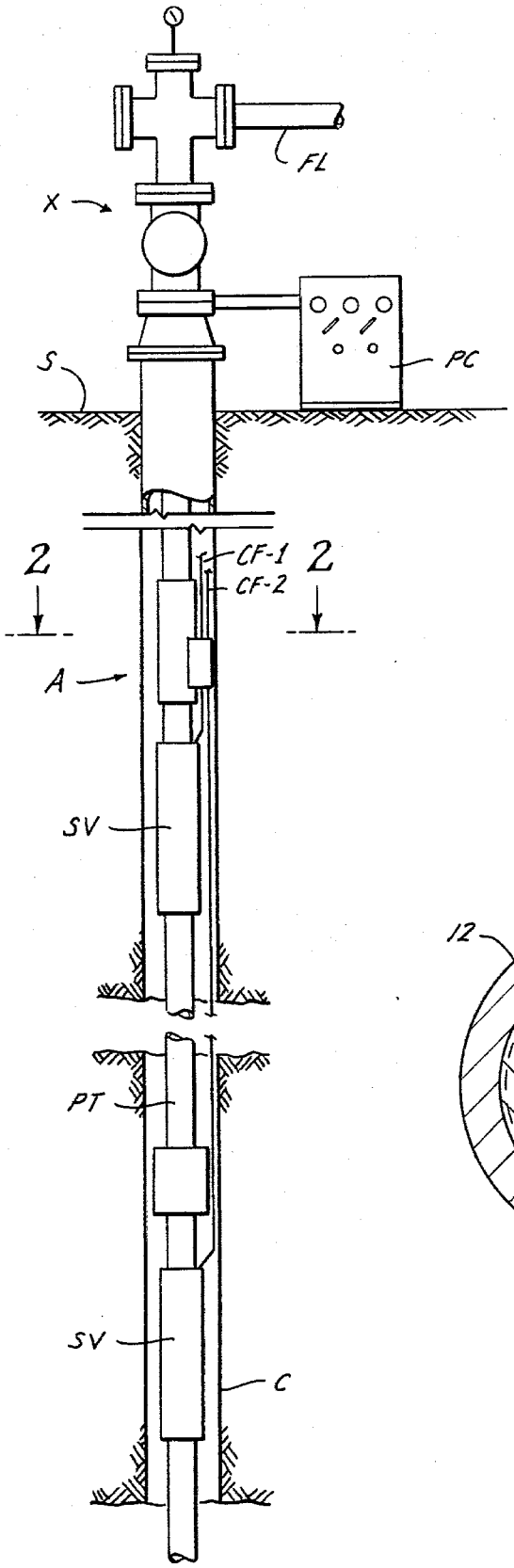
Fig. 1
Fig. 2
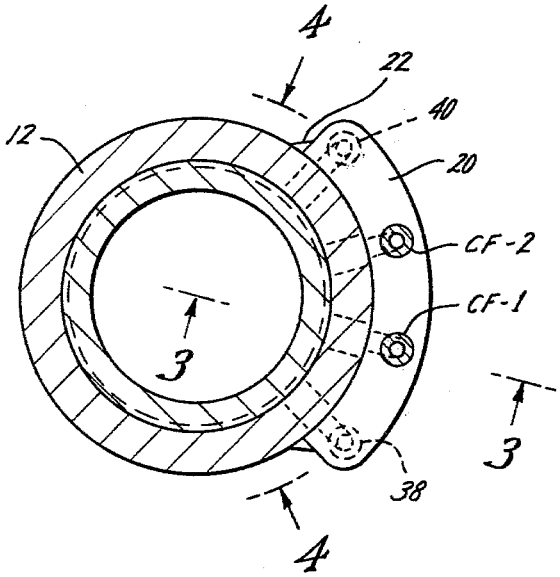

WELL SAFETY SYSTEM

DESCRIPTION

1. Technical Field

The present invention relates generally to well safety systems and more particularly to a subsurface apparatus for controlling communication of control fluid used to operate surface controlled subsurface safety valves used in hydrocarbon producing wells.

2. Background Art

In the operation of some hydrocarbon producing wells, notably offshore wells, it has become accepted practice to install surface controlled subsurface safety valves. In certain situations two tubing retrievable subsurface safety valves are run in tandem in each string of production tubing. By tubing retrievable valve, it is understood that the valve body is made up in and forms a portion of the well production tubing through which the well fluids flow to the surface, such as disclosed in Knox U.S. Pat. No. 3,035,808. Previously, the use of multiple tandem tubing retrievable valves has required provisions to run separate control lines to each valve and secure them to the production tubing, which was a very time consuming and costly operation.

Furthermore, in the case of a subsurface valve having a second or balance control fluid line to increase setting depth, such as disclosed in Mott U.S. Pat. 3,744,564, it was necessary to rework the wellhead to provide two additional flow passages for a total of four control fluid lines. Such wellhead rework was required even if the control lines were encapsulated in pairs such as disclosed in Evans, et al. U.S. Pat. No. 3,844,345. Even this was time consuming to install as the securing straps, such as disclosed in U.S. Pat. No. 4,064,601 had to be carefully secured to prevent damage to the control line bundles.

In U.S. Pat. No. 3,786,863, a subsurface sleeve valve is disclosed for closing a control fluid conduit to a landing nipple from well tubing pressure. The landing nipple is used to receive and operate a wireline retrievable subsurface safety valve. The control fluid sleeve valve is operated to and from the open and closed positions by a wireline tool run through the well tubing. The sleeve valve is disposed above the landing nipple which receives the wireline retrievable safety valve and is closed when the safety valve is retrieved from the landing nipple.

DISCLOSURE OF THE INVENTION

In accordance with the present invention a control fluid well safety tool is mounted in a well tubing above a pair of surface controlled tubing retrievable subsurface safety valves. The well safety tool is provided with a movable control fluid sleeve disposed in the bore of the well tubing and which sleeve may be shifted by well operations conducted through the bore of the well tubing. In one position of the control fluid sleeve both safety valves are operated by the control fluid pressure communicated to the switching tool and in the other position of the sleeve one safety valve is isolated from control fluid pressure from the surface and thereby rendered inoperative.

BRIEF DESCRIPTION OF THE DRAWINGS

FIG. 1 is a side view, partially in section, illustrating a hydrocarbon well having the control fluid switching tool of the present invention;

FIG. 2 is a view taken along line 2—2 of FIG. 1;

BEST MODE FOR CARRYING OUT THE INVENTION

A hydrocarbon producing well having a safety system utilizing the safety apparatus A of the present invention is illustrated in FIG. 1. Disposed within a well casing C is a production tubing PT for flowing the produced hydrocarbons from the producing zone (not illustrated) to the surface S in the usual manner. A valved production christmas tree X is disposed at the ground surface or other suitable location for normally controlling flow of well fluids from the producing formation through the production tubing PT into a flow line FL.

Disposed within the production tubing PT are a pair of surface controlled subsurface safety valves SV that are mounted in tandem in the production tubing. Preferably the safety valves SV are the tubing retrievable type rather than wireline retrievable valves set in landing nipples. The tubing retrievable type valve is made up and forms a part of the production tubing PT while the wireline valves are movable through the production tubing PT to subsurface landing nipples forming a part of the production tubing.

The subsurface safety valves SV may be of the type disclosed in Mott U.S. Pat. No. 3,744,564 which has a primary or normal control fluid line CF-1 that is used to pressure up and open the fail-safe subsurface safety valve. A second or balance control line CF-2 is also provided for balancing the hydrostatic head of the control fluid pressure. By pressuring up through the control line the subsurface safety valve may also be moved to the open position and locked therein. However, it is to be understood that the use of the present invention is not to be limited to such subsurface valves as the present apparatus may also be used with single control line valves, as disclosed in Knox U.S. Pat. No. 3,035,808. By subsurface safety valve, it is also meant to include an apparatus such as disclosed in Mott U.S. Pat. Nos. 3,856,083 and 3,858,650 for receiving and operating a through the bore receivable safety valve therein.

The subsurface safety valves SV are controlled from the surface S by a panel controller C. The panel controller PC supplies control fluid under pressure through the control fluid lines CF-1 and CF-2 to the subsurface safety valves SV to effect their operation. The subsurface control line isolation tool or apparatus A of the present invention is connected in the control fluid conduits CF-1 and CF-2 and the production tubing PT immediately above the upper of the two subsurface safety valves SV.

Figure 3:
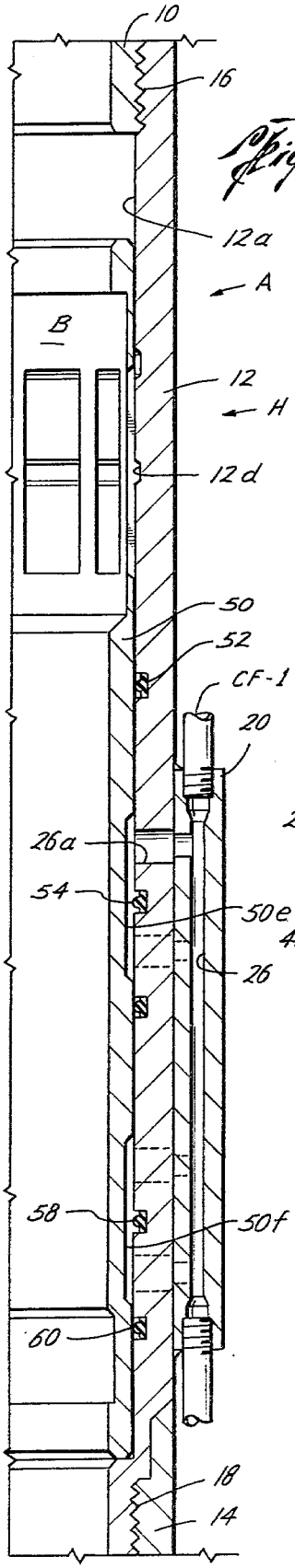
FIG. 3 is a view taken along line 3—3 of FIG. 2.
Figure 4:
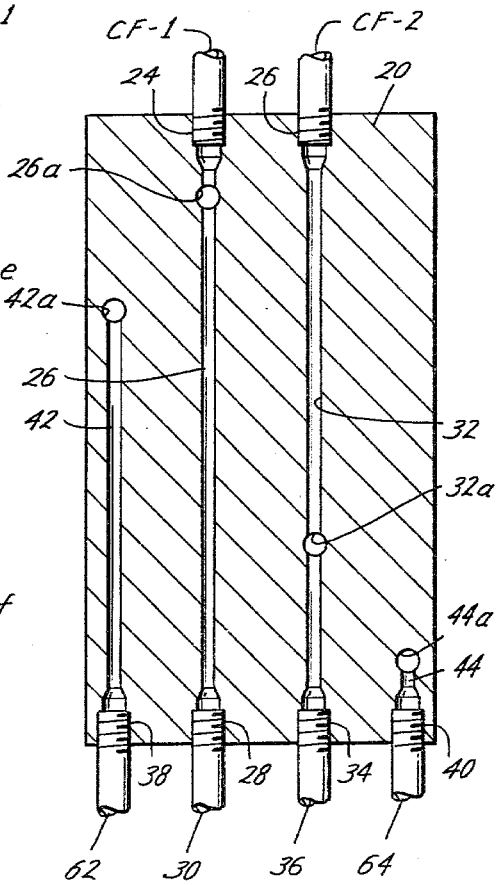
FIG. 4 is a view taken along arc 4—4 of FIG. 2.

As best illustrated in FIGS. 3 and 4, the subsurface well safety apparatus or isolation valve A for controlling the application of control fluid pressure to the surface controlled subsurface safety valves SV includes a generally elongated tubular flow housing, generally designated H, formed by outer tubular members 10, 12 and 14 which are secured together for ease of assembly by engagement of threads 16 and 18. The housing sleeve 12 is provided with a polished or sealing inner surface 12*a* partially forming a bore of flow passage B through the housing H. The polished surface 12*a* terminates at the lower end at an upwardly facing shoulder 12*b* disposed adjacent threaded engagement 18.

The upper housing sleeve 10 may be an adapter sub for either connecting the tubular member 12 in the production tubing or the threads 16 may be used for connecting in the production tubing PT as desired. Likewise, lower threaded engagement at 18 may be used to connect with a lower adapter sub 14 or directly in the production tubing PT as desired. In either event, the tubular housing H forms part of the production tubing PT for providing the central flow passage or bore B communicating with the bore of the production tubing PT through which well fluid flows from the producing formation to the surface.

As best illustrated in FIG. 2, a portion of the tubular housing H is concentrically mounted about the exterior of the tubular member 12. This housing portion 20 is secured to the tubular member 12 by welding 22 about the periphery of the member 20. The housing portion 20 (FIG. 4) is provided with an inlet flow port 24 receiving the first or normal operating control fluid conduit CF-1. A second inlet port 26 communicates with the lock open or balance control fluid conduit CF-2 in a similar manner.

Formed in the housing portion 20 is a control fluid passageway 26 for continuously and directly communicating the upper inlet port 24 with a normal or first outlet port 28 which is connected by control fluid conduit 30 to a first or upper subsurface safety valve SV. It being understood that the conduits 30 and 36 could be connected to the lower subsurface safety valve SV if it was desired to isolate the upper subsurface safety valve SV from the operating control fluid pressure. The second inlet port 26 is connected through flow passage 32 with a second outlet port 34. A control fluid conduit 36 would run from the second outlet port 34 to the same subsurface safety valve the conduit 30 would be connected to whether it be the upper or lower subsurface safety valve SV. Also formed in the housing portion 20 is a third outlet port 38 and a fourth outlet port 40. The outlet port 38 communicates with flow passage 42 formed in the housing portion 20 while the fourth outlet port 40 communicates with flow passage 44.

As is best illustrated in FIGS. 3 and 4, the flow passage 26 is provided with a radially extending opening 26*a* formed through the inner housing portion 20 and the tubular member 12 of the housing H for communicating with the bore or flow passage B of the housing H. The flow passage 32 is provided with an opening 32*a* which is located some distance below the passage 26*a*. The third outlet port 38 flow passage 42 has a similar opening 42*a* that is disposed below the upper opening 26*a* a preselected distance. The fourth inlet port 40 flow passage 44 is provided with opening 44*a* that is located a similar preselected distance below the opening 32*a* of the flow channel 32.

Disposed within the bore B adjacent the polished surface 12*a* is a movable operator sleeve 50. The operator sleeve 50 is shiftable to or from a lower position (FIG. 3) and a second or upper position (FIG. 5) for isolating the outlet ports 38 and 40 from the inlet ports 24 and 26, respectively. A plurality of longitudinally spaced seals 52, 54, 56, 58 and 60 effect a plurality of spaced sliding seals between the movable sleeve 50 and the polished inner surface 12*a* of the tubular housing 12. The sleeve 50 is provided with an annular recess 50*a* for receiving a wireline shifting tool for moving the sleeve 50 between the upper and lower positions. A number of suitable shifting tools are known to those skilled in the art and form no part of the present invention.

Figure 5:
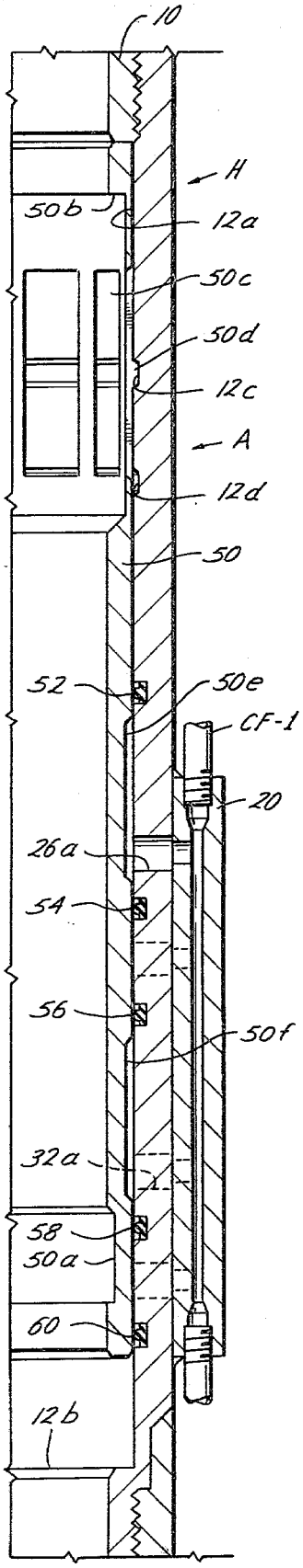
FIG. 5 is a view similar to FIG. 3 with the inner sleeve moved to the upper position.

Disposed adjacent the upper end 50*b* of the sleeve 50 is a resilient collar portion 50*c* having outwardly extending detent or lugs 50*d* formed thereon. The lugs 50*d* are received within the annular groove 12*c* formed in the housing member 12 when the sleeve 50 is moved to the upper position as illustrated in FIG. 5. When the sleeve 50 is shifted to the lower position the lugs 50*d* are received within the lower annular groove 12*d*. The resilient collar portion 50*c* enables the lugs 50*d* to flex inwardly when moving between the annular grooves 12*c* and 12*d*.

Disposed on the outer portion of the sleeve 50 is an upper annular recess 50*e* and a lower annular recess 50*f*. When the sleeve 50 is in the lower position (FIG. 3) the recess 50*e* is positioned adjacent the seal 54, thereby rendering the seal 54 ineffective and enabling communication from the opening 26*a* to the opening 42*a*. Thus, when the sleeve 50 is in the lower position, the inlet port 26*a* is placed in communication with the third outlet port 38 as well as the first outlet port 28. The lower annular recess 50*f* functions in a similar manner to relieve the sealing with the seal 58 and enable communication from the opening 32*a* to the opening 44*a* and thereby place the fourth outlet port 40 in communication with the second inlet port 26 as well as the second outlet port 34.

When the sleeve 50 is shifted to the upper position the recesses 50*e* and 50*f* are no longer positioned adjacent the seals 54 and 58 which now engage the sleeve 50 for preventing communication of the openings 26*a* to opening 42*a* and opening 32*a* to opening 44*a*. Thus, in the upper position, the sleeve 50 serves to isolate the outlet ports 38 and 40 from communication with the inlet ports 24 and 26.

Use and Operation of the Present Invention

In the use and operation of the present invention, the apparatus A is assembled in the manner illustrated with the sleeve 50 in either position. In order to test the subsurface safety valve SV when going in the well it may be desirable to have the sleeve 50 in the lower position to enable communication to both valves at any time. When the production tubing PT installation is complete and the wellhead installed, the well is completed in the usual manner.

When it is desired to produce the well the subsurface safety valve SV connected to the outlet ports 38 and 40 may be locked open and left in that condition until it is desirable to utilize that valve or the other subsurface safety valve fails. In that event, after the valve SV is locked open, a wireline tool would be run through the production tubing to shift the sleeve 50 to the upper position. Thereafter, increased control fluid pressure communicated through control fluid conduit CF-1 would not be communicated to the locked open subsurface safety valve and the other subsurface safety valve SV would operate in the usual manner. Should the subsurface safety valve connected to the conduits 30 and 36 fail or for any other reason it becomes desirable to use the isolated subsurface safety valve SV, a wireline tool will be run through the production tubing to shift the sleeve 50 to the lower position. Thereafter, both subsurface safety valves will be operable through the control fluid conduit CF-1 and CF-2 in the usual manner.

The foregoing disclosure and description of the invention are illustrative and explanatory thereof, and various changes in the size, shape and materials as well as in the details of the illustrated construction may be made without departing from the spirit of the invention.

I claim:

1. A subsurface well safety apparatus for controlling the application of control fluid to surface controlled subsurface safety valves mounted in a production tubing disposed in a well, including:

a flow housing having a flow passage formed therethrough;

means on said flow housing for mounting said flow housing in the production tubing at a subsurface location in the well;

means formed by said housing for receiving control fluid communicated from the surface independent of the well tubing;

means formed by said housing for communicating the control fluid from said housing to a first subsurface safety valve disposed in the well;

means formed by said housing for communicating control fluid from said housing to a second subsurface safety valve disposed in the well; and means carried by said housing for movement to and from a first position enabling communication of control fluid from said means for receiving to said means for communicating with the second subsurface safety valve and a second position blocking such communication of the control fluid.

2. The well safety apparatus as set forth in claim 1, wherein:

said flow housing formed by an elongated tubular member having threaded end portions for connection to the production tubing with said flow passage communicating with the bore of the production tubing above and below said tubular member.

3. The well safety apparatus as set forth in claim 2, wherein:

said means for movement to and from the first position includes a sleeve disposed in said flow passage; and shifting means movable into said flow passage for shifting said sleeve to and from the first and second positions.

4. The well safety apparatus as set forth in claim 3, wherein:

said sleeve slidably sealed to said flow housing at a plurality of spaced locations, said means for receiving including a first inlet port in said housing, said inlet port disposed at a location between two of said spaced seals on said sleeve;

said means for communicating including a first outlet port in flow communication with said first inlet port;

said means for communication including another outlet port in said housing;

said sleeve in the first position locating said seals to enable flow communication of said first inlet port and said another outlet port, said sleeve shifted to the second position moving said seals to block flow communications of said first inlet port and said other outlet port.

5. A subsurface well safety apparatus for controlling the application of control fluid pressure to surface controlled subsurface safety valves mounted in a production tubing disposed in a well, including:

an elongated tubular flow housing having a flow passage formed therethrough, said tubular flow housing having threaded end portions for connection to the production tubing with said flow passage communicating with the bore of the production tubing above and below said housing;

a first inlet port for receiving a first control fluid from the surface;

a second inlet port for receiving a second control fluid from the surface;

a first outlet port communicating with said first inlet port to provide an output source of the first control fluid;

a second outlet port communicating with said second inlet port to provide an output source of the second control fluid;

a third outlet port;

a fourth outlet port;

a sleeve disposed in said flow passage for shifting movement to and from a first position and a second position, said sleeve when in the first position enabling communication of said first inlet port with said third outlet port and said second inlet port with said fourth outlet port, said sleeve in the second position blocking communication of said first inlet port with said third outlet port and said second inlet port with said fourth outlet port wherein said sleeve controls the first control fluid to said third outlet port and the second control fluid to said fourth outlet.

* * * * *